United States Patent [19]

Hawkins et al.

[11] Patent Number: 4,615,198

[45] Date of Patent: Oct. 7, 1986

[54] APPARATUS AND METHOD FOR REFORMING AND ROLLING TUBE ENDS

[75] Inventors: Phillip J. Hawkins, Penn Hills Township, Allegheny County; David G. Francisco, West Hempfield, both of Pa.

[73] Assignee: Westinghouse Electric Corp., Pittsburgh, Pa.

[21] Appl. No.: 748,877

[22] Filed: Jun. 26, 1985

[51] Int. Cl.[4] ..... B21D 39/06

[52] U.S. Cl. ..... 72/122; 72/126

[58] Field of Search ..... 72/122, 123, 126

[56] References Cited

U.S. PATENT DOCUMENTS

| | | | |
|---|---|---|---|
| 842,877 | 1/1907 | Mathers . | |
| 898,202 | 9/1908 | Faessler | 72/126 |
| 1,516,704 | 11/1924 | Braun . | |
| 2,448,512 | 9/1948 | Brackett | 72/122 |
| 3,188,850 | 6/1965 | Linthicum . | |
| 3,247,695 | 4/1966 | Linthicum . | |
| 3,354,680 | 11/1967 | Jacobsen . | |
| 3,426,565 | 2/1969 | Schott . | |
| 3,528,498 | 9/1970 | Carothers . | |
| 3,656,333 | 4/1972 | Kruse, Jr. . | |
| 4,178,787 | 12/1979 | Gerkey | 72/122 |
| 4,242,893 | 1/1981 | Diller . | |

*Primary Examiner*—Lowell A. Larson

[57] ABSTRACT

A rolling tool for both expanding and reforming the dented end of a tube within the tubesheet of a nuclear steam generator is disclosed herein. Generally, the tool comprises a rotatable roller cage having a diameter which is approximately the same as the minimum diameter across the dented tube end, a plurality of rollers rotatably mounted within pitched slots in the roller cage, a tapered mandrel slidably movable within an opening in the cage for rotating, orbiting and radially extending the rollers, and a ring which circumscribes at least a substantial portion of the cage for providing a surface around and against which the rollers may rotate when the roller-driving mandrel is rotated. In the preferred embodiment, the cage is rotatably mounted within a collar and the ring is detachably mountable around the proximal end of the roller cage. The tool further includes a table assembly for supporting the roller cage collar, a frame for supporting the drive means of the mandrel, and a guide rod and ball-bushing arrangement for slidably mounting the table assembly to the frame. A single, hydraulic cylinder is used to selectively slide the table assembly into a tube-engaging position. In the method of the invention, successively larger roller cages and rings are used to reform and finally expand severely dented tubes.

26 Claims, 7 Drawing Figures

APPARATUS AND METHOD FOR REFORMING AND ROLLING TUBE ENDS

BACKGROUND OF THE INVENTION

1. Field of the Invention

The present invention relates to a rolling tool for both expanding and reforming the end of a tube having an off-round cross-section. It is particularly useful in reforming and expanding dented tube ends mounted around the periphery of the tubesheet of a nuclear steam generator.

2. Description of the Prior Art

Tools for expanding the ends of metallic tubes are known in the prior art. Generally, such tools include a rotatable roller cage which holds a plurality of radially extendable rollers mounted within pitched slots, and a rotatable, tapered mandrel which is slidably movable within a centrally disposed bore in the cage. In operation, the roller cage is inserted into the open end of the tube, which in turn pushes the rollers into a retracted position within the cage. Next, the tapered mandrel is simultaneously rotated and biased toward the interior of the tube, which radially extends the rollers (which are somewhat loosely held within tapered slots in the cage body) until they engage the interior surface of the tube to be expanded. Once the rollers are radially extended into such engagement, the outer surfaces of the rollers become simultaneously frictionally engaged against the inner walls of the tube, while the inner surfaces of these rollers become frictionally engaged against the rotating tapered mandrel. Such frictional engagement allows the tapered mandrel to simultaneously rotate and orbit the rollers around the axis of rotation of the mandrel. Because the slots which receive these rollers are pitched at a small angle relative to the axis of rotation in the mandrel, the rotation and the orbiting of the rollers draws the mandrel within the open end of the tube in what may be generally described as a screwing or feeding motion, which in turn radially extends the rollers further and expands the end of the tube.

Such tools have been useful in the past for eliminating potential maintenace problems associated with the heat exchange tubes in nuclear steam generators. However, in order to understand the precise utility of such tools in this context, some basic understanding of the structure and function of a nuclear steam generator is necessary.

Nuclear steam generators generally comprise a secondary side, a tubesheet, and a primary side which circulates water heated from a nuclear reactor. An example of such a generator is disclosed in U.S. Pat. No. 4,262,402, assigned to Westinghouse Electric Company, the assignee of the present invention. The secondary side of the generator includes a plurality of U-shaped tubes, as well as an inlet for admitting a flow of non-radioactive feed water. The inlet and outlet ends of the U-shaped tubes within the secondary side of the generator are mounted in a tubesheet which hydraulically separates the primary side of the generator from the secondary side. The primary side in turn includes a divider sheet which hydraulically isolates the inlet ends of the U-shaped tubes from the outlet ends. Hot, radioactive water flowing from the nuclear reactor is forceably pumped through the primary side of the generator (which is bowl-shaped) into the inlet ends of the U-shaped tubes. This hot, radioactive water flows through these inlets, up to the tubesheet, and circulates around the U-shaped tubes which extend within the secondary side of the generator. The water transfers its heat through the walls of the U-shaped tubes to the non-radioactive feed water flowing through the secondary side of the generator, thereby converting this feed water into non-radioactive steam which in turn powers the turbines of an electric generator. After the water from the reactor circulates through the U-shaped tubes, it flows back through the tubesheet, through the outlets of the U-shaped tubes, and into the outlet section of the primary side, where it is recirculated back to the nuclear reactor.

The walls of the heat exchange tubes in such nuclear steam generators can suffer any number of different forms of corrosion degradation, including denting, stress corrosion cracking, intragranular attack, and pitting. In situ examination of the tubes within these generators has revealed that most of the corrosion degradation occurs in what are known as the crevice regions of the generator. The principal crevice region for each of the U-shaped tubes is the annular space between the heat exchange tube and the bore in the tubesheet through which the tube extends. Corrosive sludge tends to collect within this crevice from the effects of gravity. Moreover, the relatively poor hyraulic circulation of the water in this region tends to maintain the sludge in this annular crevice, and to create localized "hot spots" in the tubes adjacent the sludge. The heat radiating from these "hot spots" acts as a powerful catalyst in causing the exterior walls of the heat exchange tubes to chemically combine with the corrosive chemicals in the sludge.

In order to prevent such corrosion and tube cracking from occurring in the annular crevices surrounding the tubes in the tubesheet, prior art rolling tools have been used to radially expand the ends of these tubes extending through the tubesheet. Such tube expansions eliminate the annular space between the bores of the tubesheet, and the heat exchange tubes. While such prior art tools are capable of effectively expanding the ends of undamaged tubes in the central portion of the tubesheet, such tools are difficult (if not impossible) to use in tube ends which have been dented into an off-round shape by hard bits of debris (such as nuts, bolts, cover plates, etc.) which have inadvertently found their way into the fast-flowing water of the primary system of the generator. Such dents around the ends of the heat exchange tubes prohibit the insertion of a roller cage having a diameter large enough to effectively expand the tube against its respective bore in the tubesheet. If the operator of such a tool uses a cage of a smaller diameter in an attempt to reform the shape of the tube into a circular cross-section, the rollers of the case may become "stalled" when the roller-engaging mandrel is extended and rotated due to the fact that the off-center shape of the interior of the tube may prevent some (if not all) of the rollers from frictionally engaging the inner tube wall when the mandrel is rotated. If the rollers of the cage do not frictionally engage the inner walls of the tube when the mandrel is extended and rotated, the rollers cannot orbit against the inner wall in a tube-reforming motion. Such a failure of the tool to reform the tube end would not only prevent the rolling tool from eliminating the annular space between the outer wall of the tube and the bore which surrounds it in the tubesheet, but would also prevent other tube maintenance devices (such as eddy current probes, sleeving tools, rotopeening spindles and plugs) from being inserted into the open end of the tube.

Still another shortcoming of such prior art rolling tools is the difficulty in using them to roll or reform the peripherally-located tube ends around the outer edges of the tubesheet. Such tube ends are located directly adjacent the inside wall of the bowl-shaped primary side of the nuclear steam generator, and it is difficult, if not impossible, to manipulate some tools in these area. Finally, some of these rolling tools are non-automatic, which in turn necessitates exposing a human operator to the potentially dangerous radioactivity existing within the primary side of the generator.

Clearly, there is a need for a tool cabable of reliably reforming and expanding a dented tube end in the tubesheet of a nuclear steam generator. Ideally, such a tool should be remotely controllable, and fully cabable of easily and conveniently reforming and expanding the ends of tubes located in the peripheral regions of the tubesheet of the generator.

SUMMARY OF THE INVENTION

In its broadest sense, the invention is both an apparatus and a method for reforming and rolling the ends of tubes in the tubesheet of a nuclear steam generator which are off-round or deformed due to denting. Generally, the apparatus of the invention includes a rotatable roller cage having at least one roller, a central opening for slidably receiving a tapered mandrel which rotates, orbits and radially extends the roller, and a ring which circumscribes at least a substantial portion of the cage for providing a surface against which the roller can react when the roller-driving mandrel is rotated. In the preferred embodiment, the roller cage is rotatably mounted upon a collar, which in turn is mounted upon a table assembly slidably attached to a frame which supports the means for driving the mandrel. When the invention is used to reform and roll the ends of peripherally located tubes in the tubesheet of a nuclear steam generator, the profile of the working side of the table assembly and the frame is preferably complementary in shape to the arcuate profile of the bowl of the nuclear steam generator. Additionally, the drive means within the frame (which is preferably a reversible hydraulic motor having an elongated housing) is positioned within the frame so as not to mechanically interfere with the placement of the collar-holding table assembly in tube-engaging positions around the periphery of the tubesheet of the generator. These last two structural features allow the apparatus of the invention to conveniently and easily reform and roll the most peripherally-located tube ends within the tubesheet of the generator.

In the method of the invention, the ring is preferably detachably mounted on top of the collar and around the proximal end of the roller cage of the device of the invention. The inner diameter or the ring is chosen so that it is approximately the same as the minimum inner diameter of the dented tube. The outer diameter of the roller cage is chosen so that it is a little smaller that the minimum inner diameter of the dented tube end. When the roller cage is inserted within the dented tube end and the mandrel is extended and rotated, the ring circumscribing the proximal end of the roller cage provides a continuous annular surface upon and around which the rollers in the cage may smoothly roll as they at least partially reform the off-round cross-section of the dented tube end. In cases where the tube end denting is substantial, the reforming operation may have to be repeated with a second roller cage having a larger outer diameter than the first, and a second ring having an inner diameter which approximately matches the enlarged, minimum inner diameter of the dented tube end. Successively larger roller cages and rings are used until the tube end is finally reformed into a circular shape. A final roller cage may then used without a ring in order to expand the tube end into engagement with the bore in the tubesheet in which it is housed.

BRIEF DESCRIPTION OF THE SEVERAL FIGURES

DETAILED DESCRIPTION OF THE PREFERRED EMBODIMENT

General Overview of the Structure and Operation of the Invention

Figure 1:
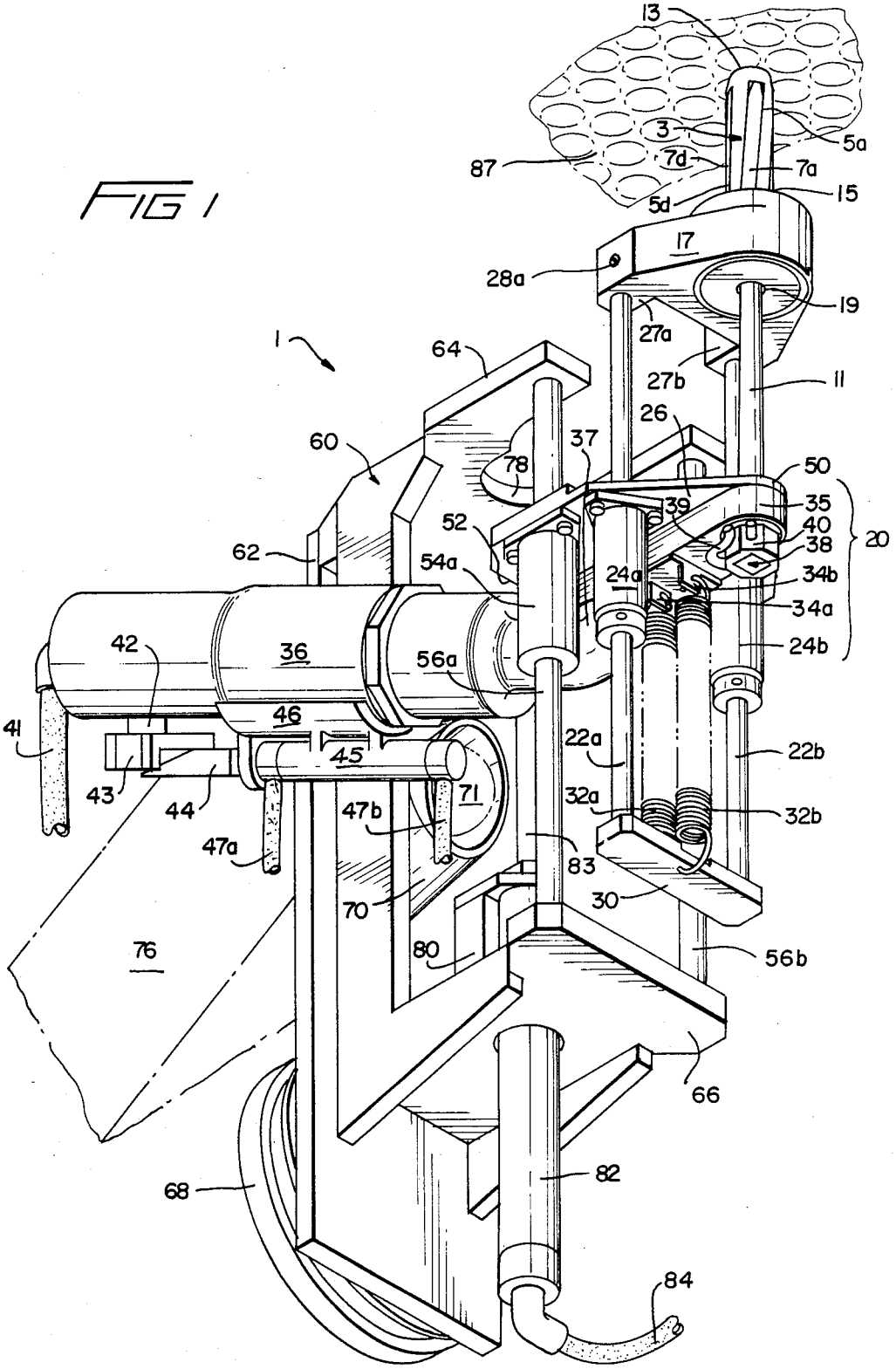
FIG. 1 is a perspective view of the preferred embodiment of the invention.
Figure 2:
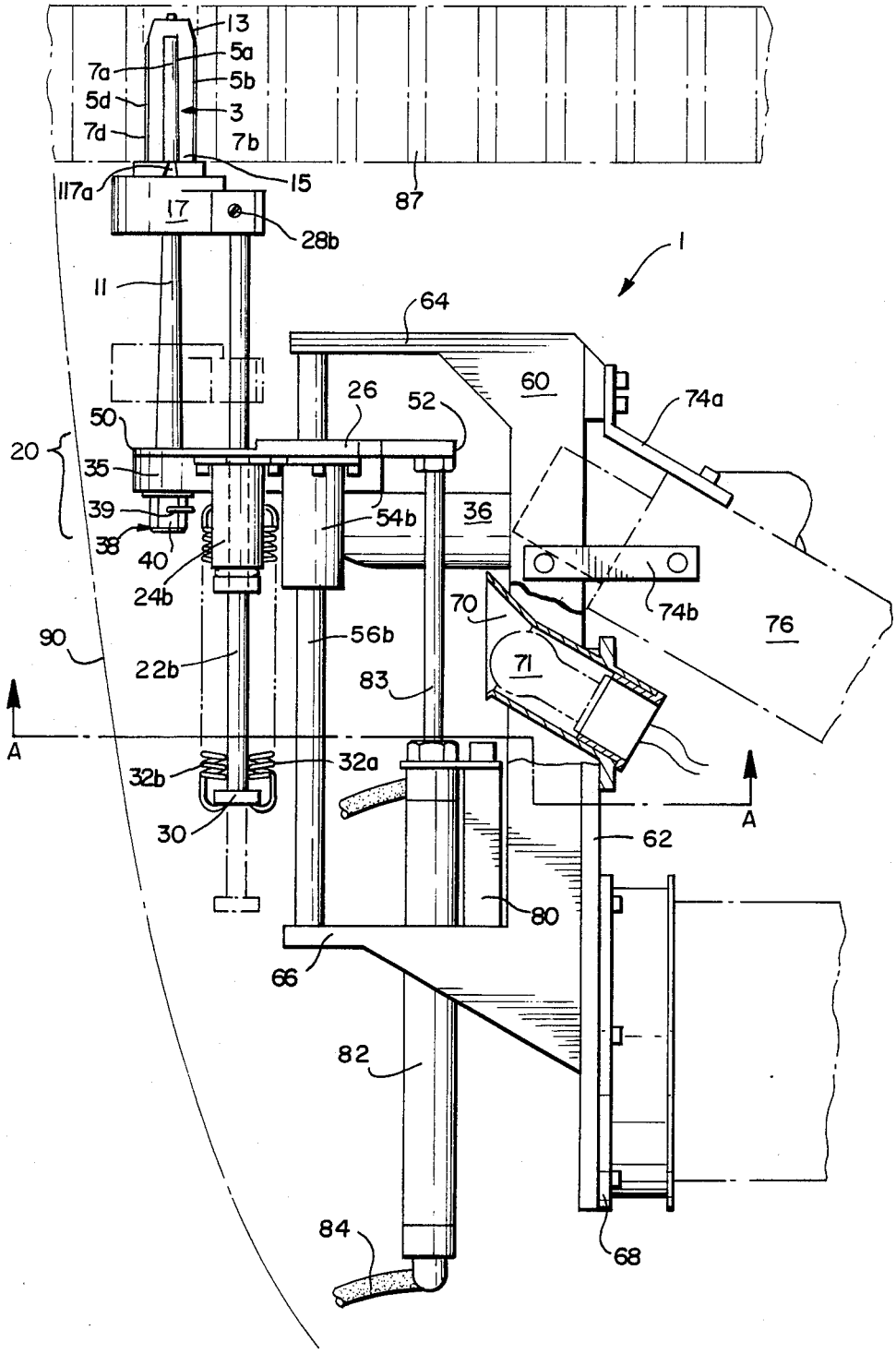
FIG. 2 is a side view of this preferred embodiment, illustrating how the working edge of the tool complements the arcuate shape of the bowl-shaped primary side of a nuclear steam generator.

With reference now to FIGS. 1 and 2, wherein like numerals designate like components throughout all of the several Figures, the rolling and reforming tool 1 of the invention generally comprises a roller cage 3 rotatably mounted within a thrust collar 17, and a tapered mandrel 11 which may be extended into the cage 3 to drive the cage rollers *7a–7d*. The thrust collar 17 is in turn slidably and resiliently mounted upon a table assembly 20 by means of a pair of spring-loaded guide rods 22*a*, 22*b* which are received within a pair of ball-bushings 24*a*, 24*b* as shown. The table assembly 20 includes a table plate 26 onto which the aforementioned ball-bushings 24*a*, 24*b* are mounted, along with a drive train 35 for linking the rotatable mandrel 11 to a reversible, torque-limited air motor 36. The entire table assembly is in turn slidably mounted by means of ball-bushings 54*a*, 54*b* and guide rods 56*a*, 56*b* onto a frame 60. The frame 60 includes a single hydraulic lifting cylinder 82 for reciprocating the table assembly 20 from a retracted position to an extended, tube-engaging position wherein the roller cage 3 is positively biased against the open end of a tube 85 in a tubesheet 87. As is best seen with respect to FIG. 2, the leading edge of the tool 1 is generally complementary in shape to the arcuate profile 90 of the bowl-shaped wall of the primary side of a nuclear steam generator, in order that the tool 1 may be used to reform and roll heat exchange tubes 85 located around the periphery of the tubesheet 87.

Figure 5:
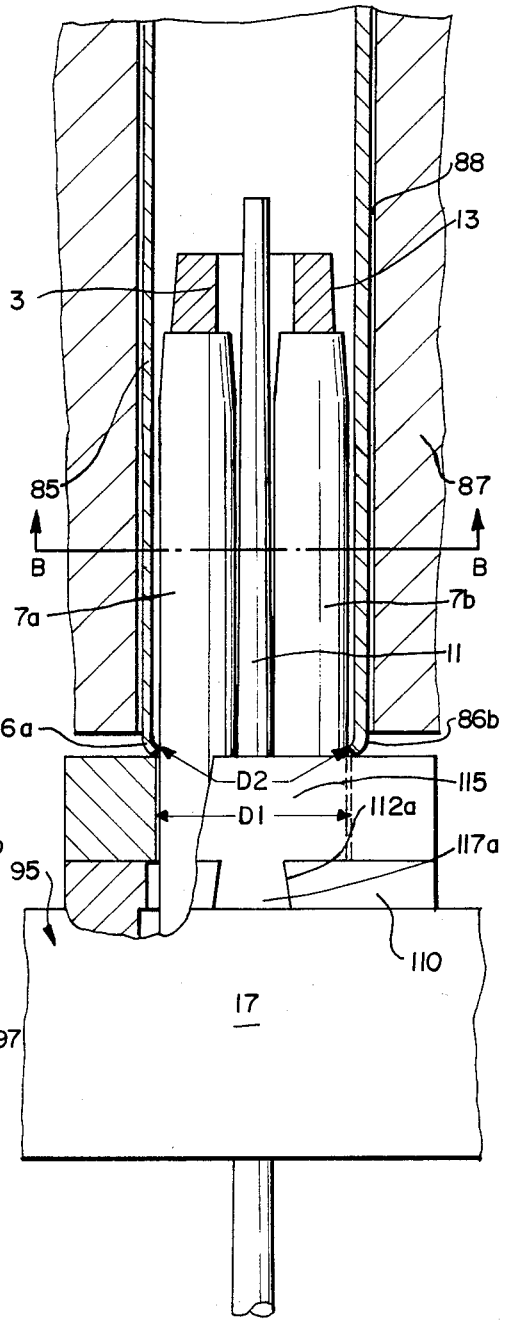
FIG. 5 is a cross-sectional side view of the roller cage, thrust collar, and ring of the invention reforming the end of a dented heat exchange tube in a tubesheet.
Figure 6:
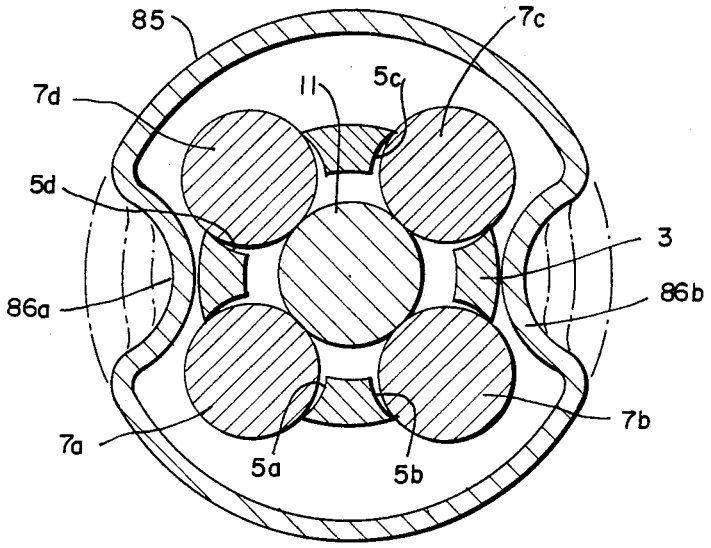
FIG. 6 is a cross-sectional view of the roller cage and tube end taken along line B—B in FIG. 5.

FIGS. 5 and 6 best illustrate how the tool 1 operates to reform a tube 85 which is dented in areas 86*a*, 86*b*. In operation, a ring 115 having a pair of opposing dovetails 117*a*, 117*b* is laterally slid into complementary dovetail slots 112*a*, 112*b* located on a ring support flange 110 which is integrally formed on the top portion of the thrust collar 17. The inner diameter D1 of the ring 115 is selected so that it is substantially the same as the minimum inner diameter D2 of the dented tube end. A cage 3 having a diameter which is a little less than the inner diameter D2 of the tube end is selected and mounted within the thrust collar 17. When the mandrel 11 is extended through the cage 3 and rotated, the rollers *7a–7d* will radially expand against the inner diameter D1 of the ring 115, and thereby cause the rollers *7a–7d* to both rotate within their respective pitched slots within the cage 3, and to orbit about the mandrel 11. The end result is that the dented portions 86*a*, 86*b* of the tube 85 will be at least partially reformed.

FIG. 6 illustrates why the rollers *7a–7d* would "stall" and fail to effect a reformation in the tube end if no ring 115 were present atop the thrust collar 17. Specifically, while it is clear that the mandrel 11 could extend and rotate the rollers *7a–7d*, it is also clear that these rollers could in no way cause the cage 3 to rotate within the dented end of the tube 85, since there is no surface upon which they could gain the required traction to rotate the cage 3 around the dented end of the tube 85. Hence, FIG. 6 illustrates how the off-round shape of the end of the tube 85 will effectively prevent the rollers *7a–7d* from reacting against the inner surface of the tube, rotating the cage, and reforming the end of the tube. However, the provision of a ring 115 having an inner diameter D1 which is approximately the same as the minimum inner diameter D2 of the dented end of the tube allows the tool 1 to reform the off-round tube end by providing a reactive surface upon which the rollers *7a–7d* may react.

Specific Description of the Structure and Operation of the Invention

With reference again to FIGS. 1 and 2, the rolling and reforming tool 1 of the invention includes a roller cage 3 having four pitched slots *5a–5d*, each of which loosely receives a tapered roller *7a–7d*, respectively. Each of these rollers *7a–7d* is both rotatable within, and radially extendable through, its respective pitched slot *5a–5d*. In the preferred embodiment, the pitch of each of the slots *5a–5d* is chosen to be a relatively small angle with respect to the axis of rotation of the cage 3. The existence of some pitch or incline in each of the slots *5a–5d* is important, because without such a pitch the rollers would not screw into or feed the tapered mandrel 11 into the open end of a tube during the reforming or rolling operation. In addition to the pitched slots *5a–5d*, the roller cage 3 also has a centrally disposed bore 9 for receiving the tapered mandrel 11. As will be discussed in detail hereinafter, the tapered mandrel 11 drives each of the tapered rollers *7a–7d* by both rotating these rollers within their respective slots *5a–5d* in the cage 3, as well as by radially extending these rollers toward the inner wall of the tube being reformed or expanded. Finally, it sould be noted that the distal end 13 of the roller cage 3 is tapered in order to facilitate the insertion of the cage 3 within an off-round tube end, while the proximal end 15 of the cage 3 is rotatably mounted within a thrust collar 17 by means of a bearing assembly which will be described in detail later.

As is best seen with respect to FIG. 1, the leading edge of the thrust collar 17 is the narrowest of its edges, in order to facilitate the manipulation of the roller cage 3 into an area of limited access on the tubesheet 87, such as its periphery. Like the roller cage 3, the thrust collar 17 likewise includes a centrally disposed bore 19 for receiving the tapered mandrel 11.

Both the cage 3 and the thrust bearing 17 are slidably and resiliently mounted onto a table assembly 20 by means of a pair of spring-loaded guide rods 22*a*, 22*b*. These guide rods are received within a pair of ball-bushings 24*a*, 24*b* mounted on opposite sides of the table plate 26 of the table assembly 20. While not shown in any of the several Figures, each of the ball-bushings 24*a*, 24*b* (as well as ball-bushings 54*a*, 54*b*, which will be discussed later) includes a pair of ball bearing assemblies mounted on either end thereof so that each of the guide rods 22*a*, 22*b* are circumscribed by ball bearings at the upper and lower portions of the ball-bushings. The distal ends of each of the guide rods 22*a*, 22*b* are detachably mounted onto a pair of opposing mounting legs 27*a*, 27*b* by means of removable cotter pins 28*a*, 28*b*, respectively. Although not specifically shown in any of the several Figures, the guide rods 22*a*, 22*b* are received within bores present in each of the mounting legs 27*a*, 27*b*.

Turning now to the bottom ends of each of the guide rods 22*a*, 22*b*, each of these ends is mounted within a rod-receiving bore in a carriage bar 30. The carriage bar 30 is in turn resiliently mounted to the underside of the table assembly 20 by means of a pair of springs 32*a*, 32*b*. These springs 32*a*, 32*b* are connected at their distal ends to a pair of spring brackets 34*a*, 34*b* extending from the underside of the table assembly 20, and at their proximal ends to the aforementioned carriage bar 30. The springs 32*a*, 32*b* bias the mandrel away from the thrust collar 17 and its roller cage 3, so that the upper and relatively narrow part of the tapered mandrel 11 extends through the centrally disposed bore 19 within the thrust collar 17 when the tool is not in use. However, when the tool is mounted beneath a tubesheet and the hydraulic lifting cylinder 82 is actuated, the cage 3 is inserted into the end of a tube, and the biasing force applied by the springs 32*a*, 32*b* is overcome so that the table assembly 20 and the thrust collar 17 are pressed relatively closer together. When this occurs, the thicker, lower section of the tapered mandrel 11 is then introduced through the thrust collar 17 and the centrally disposed bore in the roller cage 3 in order that the mandrel 11 might drive the rollers *7a–7d* of the roller cage 3. When the lifting cylinder 2 is deactuated, the springs 32*a*, 32*b* help withdraw the mandrel 11 out of the cage 3 and the thrust collar 17, as will be described in more detail hereinafter.

Figure 3:
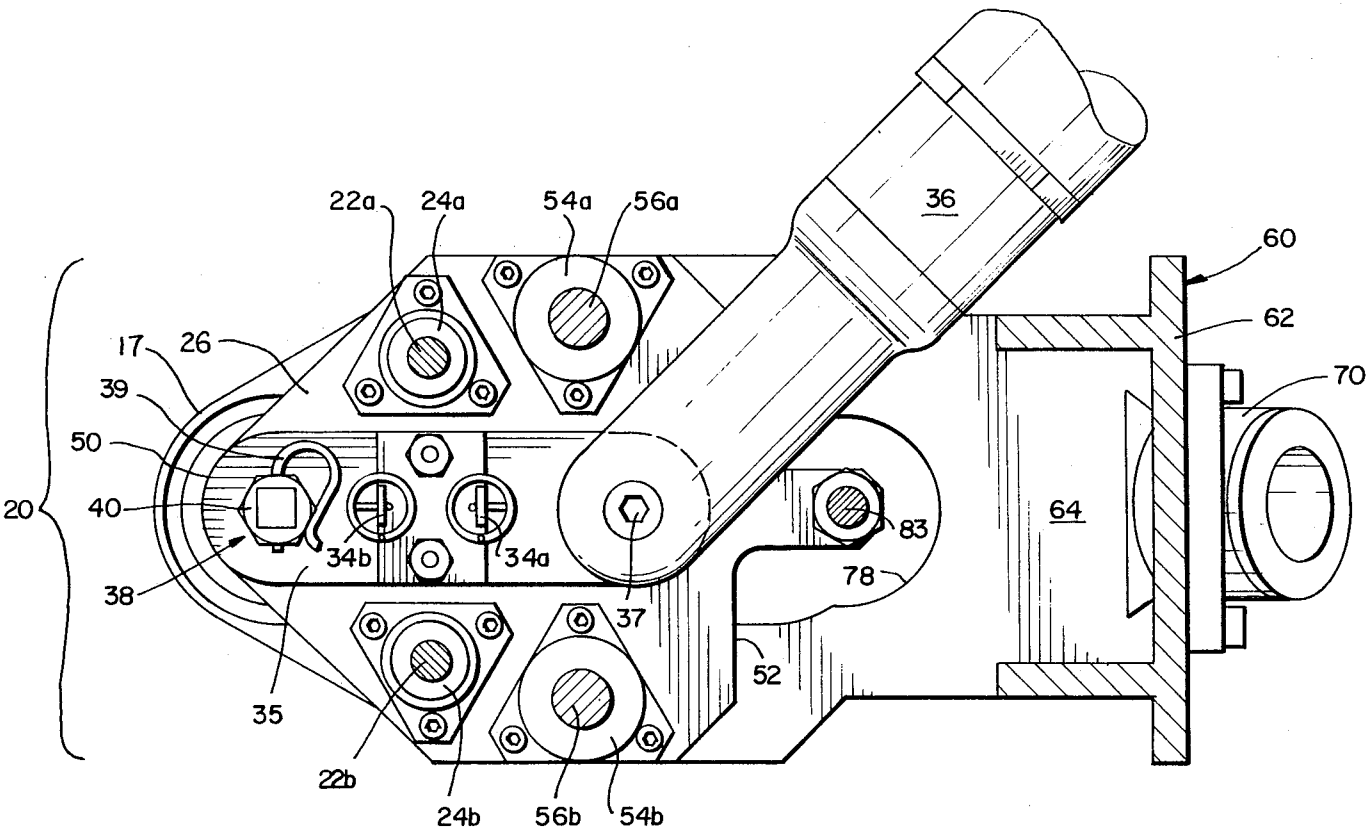
FIG. 3 is a bottom plan view of the preferred embodiment of the invention taken along line A—A in FIG. 2.

With reference now to FIGS. 1 and 3, a drive train 35 is mounted on the underside of the table plate 26 of the table assembly 20. On its trailing side, the drive train 35 is connected to a reversible, torque-limited air motor which drives the tapered mandrel 11, and ultimately the rollers *7a–7d* in the roller cage 3, to reform or to expand a tube end. In the preferred embodiment, this air motor 36 is preferably a 500 rpm Model F30LR8TA-5 pneumatic motor manufactured by the Stanley Air Tools Division of Stanley Works, Inc., of Cleveland, Ohio. The pivotal drive joint 37 which is a part of the aforementioned commercially available air motor is preferably adjusted to a 45° angle, as indicated in FIG. 3. Such angling of the air motor 36 relative to the table assembly 20 renders the tool manipulable in regions of limited access within the primary sides of nuclear steam generators. Additionally, the torque-limiting feature of the air motor 36 insures that the roller cage 3 will not exert an excessive amount of pressure onto the tube end during a rolling operation. Excessive pressure could render the tube more susceptible to stress-corrosion cracking, thus defeating the purpose of the invention 1. On its leading edge, the drive train 35 is detachably connected to the tapered mandrel 11 by means of a cotter pin assembly 38, having a cotter pin 39 which is insertable through a bore (not shown) in an insert 40. The provision of such a cotter in assembly 38 is important in the operation of the invention, since it makes it very easy to exchange one mandrel 11 for another.

As may best be seen now with reference to FIG. 1, the reversible, torque-limited air motor 36 includes a compressed air line 41 for powering the motor, and an air flow diverter button 42 for reversing the direction of the motor (and hence the rotational direction of the tapered mandrel 11). This air flow diverter button 42 is controlled by means of a wedge-receiving block 43 connected thereto, which interacts with a wedge 44 connected to the output shaft of a reversible hydraulic cylinder 45. The air flow diverter button 42 is normally biased outwardly in the position shown in FIG. 1 when the wedge 44 is in a retracted position. However, when compressed air is admitted into air line 47*b*, the piston within the hydraulic cylinder 45 slides to the rear of the cylinder and drives the wedge 42 into the wedge receiving block 43, thereby depressing the air flow diverter button 42. Conversely, when compressed air is admitted into air line 47*a* of the hydraulic cylinder 45, the piston is retracted back into its initial position, which in turn retracts the wedge 44 out of the wedge-receiving block 43, and allows the air flow diverter button 42 to extend back out into the position shown. The reversible hydraulic cylinder 45 is connected onto the housing of the reversible, torque-limited air motor 36 in a conventional fashion by means of an arcuate bracket 46, as shown.

The final noteworthy features of the table assembly 20 include the tapered shape of the leading edge 50 of the table plate 26, and the ball-bushings 54*a*, 54*b* which are mounted onto opposite sides near the relatively flat trailing edge 52 of this plate. As was the case with the tapered edge of the thrust collar 17, the provision of a tapered edge 50 on the table plate 26 renders the tool 1 as a whole more easily manipulable in areas of difficult access within the primary side of a nuclear steam generator.

Turning now to the frame 60 of the reforming and rolling tool 2 and FIGS. 1, 2 and 3, the frame 60 generally comprises a vertically oriented strongback plate 62 which is integrally connected to an upper support plate 64 and a lower support plate 66. Strongback plate 62 includes at its bottom end a coupling plate 68 for mechanically connecting the tool 1 to a robotic arm, such as the ROSA arm disclosed and claimed in U.S. Pat. No. 4,262,402, assigned to Westinghouse Electric Corporation, the assignee of the present invention. Located immediately above the coupling plate 68 on the strongback plate 62 is a light shield 70 for protecting and for columnating the light generated by a light bulb 71. At its upper portion, the strongback plate 62 includes a pair of brackets 74*a*, 74*b* for mounting a television camera 76 having a lens (not shown) disposed over the light 71, and aimed toward the roller cage 3. The provision of a light 71 and a television camera 76 renders the tool 1 remotely controllable by means of a robotic arm such as the above-mentioned ROSA arm. In order that a maximum amount of light from the light 71 might be cast upon the roller cage 3 and the tubesheet 87 being serviced, a cloverleaf cutout 78 is present in the upper plate 64 of the frame 60. The lower plate 66 includes a bracket 80 for mounting a hydraulic lifting cylinder 82 thereon. The distal end of the operating rod is connected to a tongue extending out of the flat trailing edge 52 of the table plate 26. An air hose 84 is coupled to the bottom portion of the hydraulic cylinder 82 in order to selectively extend or retract the operating rod 83. Because the operating rod 83 links the frame 60 to the table assembly 20 which is in turn slidably movable over guide rods 56*a*, 56*b*, the actuation or deactuation of the hydraulic cylinder 82 will either lift the thrust collar 17 and its roller cage 3 into a tube-engaging position, or retract it back down into a non-tube-engaging position, as is indicated in phantom in FIG. 2.

As is best seen in FIG. 2, the profile of the entire leading edge of the reforming and rolling tool 1 is complementary in shape to the arcuate wall 90 of the bowl-shaped primary side of a nuclear steam generator. Such configuring of the various principal components of the reforming and rolling rool 1 again enhances the manipulability of the tool 1 as a whole in tight spaces within the primary side of a nuclear steam generator.

Figure 4:
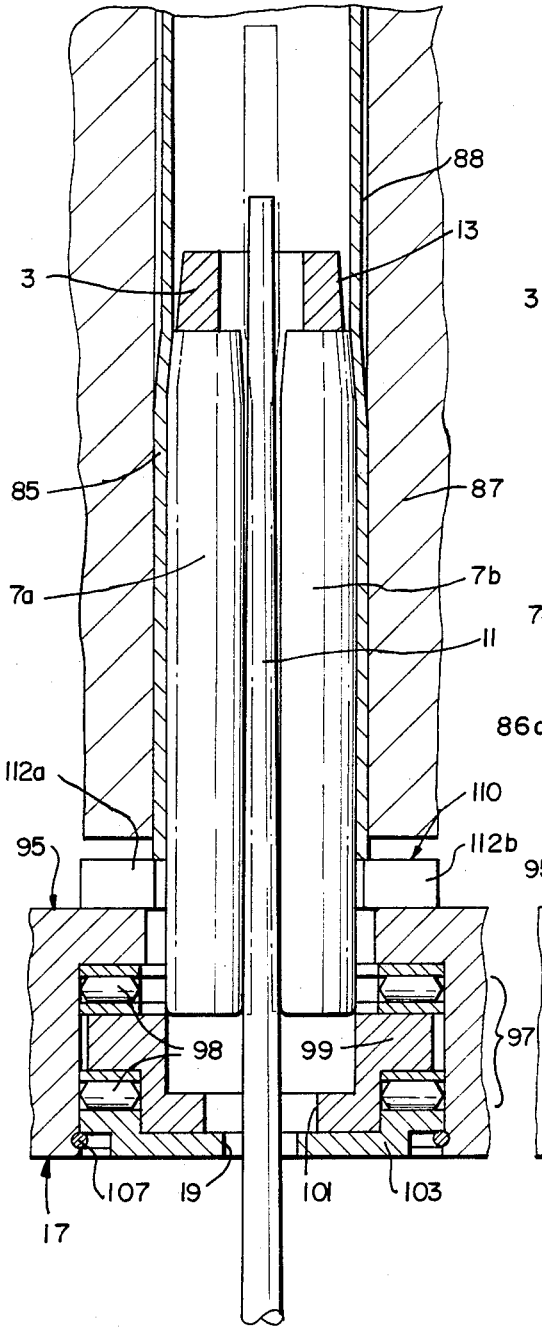
FIG. 4 is a cross-sectional side view of the roller cage and thrust collar of the tool expanding the end of an undented heat exchange tube extending through the bore of a tubesheet.

With reference now to FIGS. 4 and 5, the thrust collar 17 includes a casing 95 for holding a bearing assembly 97. The bearing assembly 97 in turn contains a plurality of roller bearings 98 disposed over the top and bottom sides of the proximal annular flange 99 of the roller cage 3. Both the structure of the bearing assembly 97 and its interaction with the proximal flange 99 of the roller cage 3 is conventional, and accordingly no specific description of the same will be given herein. Suffice to say that the rollers 98 of the bearing assembly 97 allow the cage 3 to rotate within the thrust collar 17 with a minimum amount of friction despite the application of a tensile load between the cage 3 and the thrust collar 17 when the cage 3 is screwing or feeding itself up through the open end of a tube 85. On its bottom surface, the proximal flange 99 of the roller cage 3 abuts a retainer plate 103 which keeps the bearing assembly 97 and the flange 99 in place within the thrust collar 17. The retainer plate 103 includes the previously mentioned bore 19 for receiving the taperd mandrel 11. Bore 19 is concentrically disposed with respect to another centrally disposed bore 101 which extends throughout the longitudinal axis of the roller cage 3. Located on top of the thrust collar 17 is a ring support flange 110. This flange 110 includes a pair of opposing dovetail slots 112*a*, 112*b* for receiving complementary dovetails 117*a*, 117*b* present on the bottom side of a ring 115. The provision of such slots 112*a*, 112*b* in the ring support flange 110, and of the dovetails 117*a*, 117*b* on the bottom side of the ring 115, render the ring 115 detachably mountable onto the ring support flange 110. This dovetail arrangement also prevents the ring 115 from being lifted off from the top surface of the ring support flange 110 during a reforming or rolling operation.

The operation of the reforming and rolling tool 1 may best be understood with reference to FIGS. 2, 4, 5 and 6. FIGS. 2 and 4 illustrate the operation of the tool 1 in expanding the open end of a heat exchange tube 85 within a bore in a tubesheet 87 in order to eliminate the sludge-collecting annular space 88 between the outer wall of the tube 85 and the inner wall of the bore of the tubesheet 87 which surrounds it.

In the first step of the operation, the previously mentioned robotic arm positions the frame 60 of the tool 1 so that the tapered edge 13 of the roller cage 3 is aligned with the open end of the tube 85. At this juncture, the operating rod of the hydraulic cylinder 82 is in a retracted, non-actuated position. Next, the hydraulic lifting cylinder 82 is actuated. The operating rod overcomes the force of the springs 32*a*, 32*b* and pushes the roller cage 3 into the open end of the tube 85 until the cage 3 is completely inserted therein. Additionally, the lower, thicker part of the mandrel 11 is pushed through the bore 19 of the thrust collar 17 and thence through the roller cage 3, thereby engaging the mandrel 11 against the rollers 7*a*–7*d*, which in turn radially extends them against the inner wall of the tube 85. The reversible pneumatic motor 86 is then actuated in order to rotate the rollers 7*a*–7*d* in a counterclockwise direction (looking down on the tool 1). The rollers 7*a*–7*d* in turn engage the inner walls of the tube 85, and rotate the entire cage in a counterclockwise direction. The slight pitch of the slots 5*a*–5*d* which contain the rollers 7*a*–7*d* causes the mandrel 11 to advance into the tube 85 as the rollers 7*a*–7*d* rotate the cage 3 in a counterclockwise direction due to the screwing or feeding force they apply onto mandrel 11.

FIG. 4 indicates the result of this operation. As is shown in this figure, the mouth of the tube 85 is smoothly expanded outwardly into contact with the inner walls of the surrounding bore of the tubesheet 87. After the rolling operation is complete, the reversible hydrauic cylinder 45 is actuated to drive the wedge 44 into the wedge-receiving block 43, in order to depress the air flow diverter button 42. This, in turn, reverses the direction of the air motor 36, which in turn reverses the direction of rotation of the tapered mandrel 11. At the same time, the hydraulic lifting cylinder 82 is deactuated so that the tensile force applied to the mandrel 11 by the springs 32*a*, 32*b* is no longer overcome. The mandrel 11 is then withdrawn out of the cage as a result of the spring-assisted unscrewing motion which the rollers 7*a*–7*d* apply onto the mandrel.

FIGS. 5 and 6 illustrate the operation of the tool 1 as a reforming device. In order to reform the open end of the tube 85 which includes dents such as the opposing dented regions 86*a*, 86*b* best seen in FIG. 6, a rolling cage 3 is selected which has a diameter slightly smaller than the minimum diameter D2 across the dented tube end. If such a cage 3 were inserted into the dented tube end in the manner described with respect to the tube rolling operation, the rollers 7*a*–7*d* would align themselves in the "stalled" position illustrated in FIG. 6. Even if the tapered mandrel 11 were inserted to its maximum extent through the cage 3 so that the rollers 7*a*–7*d* were extended to their maximum radial extent, the rollers 7*a*–7*d* still would not engage the inner wall of the tube 85. Consequently, the cage 3 could not rotate when the mandrel 11 was rotated and no reformation of the dented tube end would occur. However, if a ring 115 (as illustrated in FIG. 5) is mounted over the ring support flange 110 of the thrust collar 17 in the manner previously described, the situation can change radically, so long as the inner diameter D1 of the ring 115 is approximately the same as the minimum diameter D2 across the dented tube end. In such a case, the rollers 7*a*–7*d* now have a surface in the form of the inner diameter of the ring 115 to which they can react and against which they can rotate. More precisely, the inner diameter 115 affords a surface against which the rollers 7*a*–7*d* can acquire traction. This roller traction in turn causes the cage 3 to rotate, and the extended rollers 7*a*–7*d* to push the dented regions 86*a*, 86*b* radially toward their initial positions, thereby at least partially reforming the dented tube end back into its initial, circular shape. For severely dented tubes, cages 3 and rings 115 having successively larger diameters D2 and D1 may have to be used in order to completely reform the dented tube end back into its initial circular shape. The provision of the aforementioned cotter pin assembly 38, wire ring retainer 107 at the bottom of the thrust collar 17, and the detachable dovetail joint between the ring 115 and the ring support flange 110, render it easy to quickly change the mandrel 11, roller cage 3, and ring 115 in the tool 1.

Figure 7:
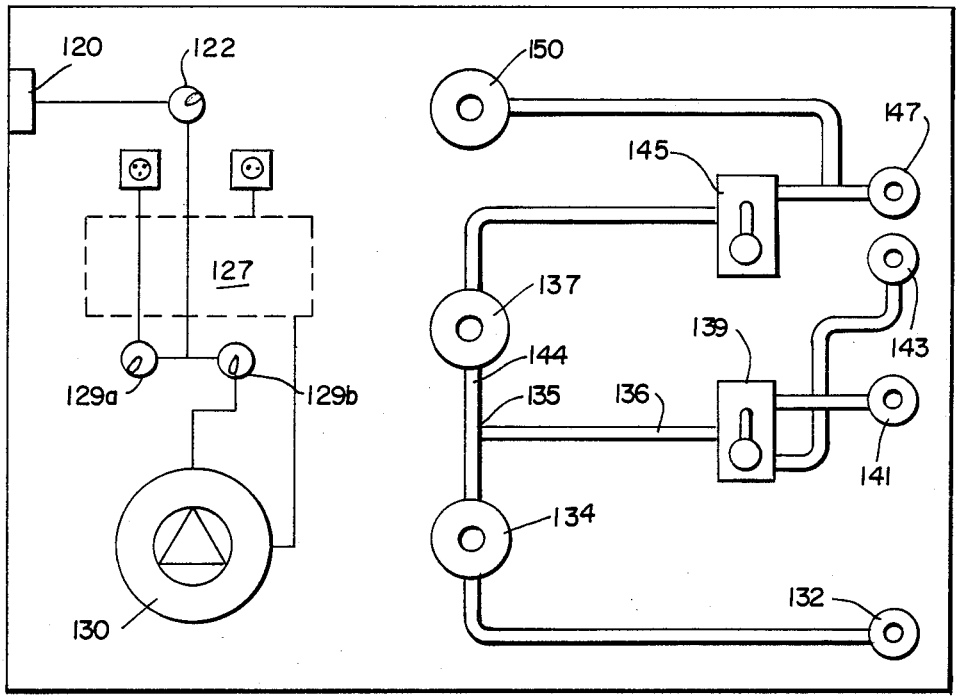
FIG. 7 is a schematic diagram of the control system of the preferred embodiment of the invention.

FIG. 7 illustrates the electrical and pneumatic control circuitry of the rolling and reforming tool 1. The electrical circuitry of the control system generally includes a source 120 of 110-volt A.C. current which is connected in parallel to a solenoid connector 124*a* via a switch 129*a*, and a powerstat or light dimmer 130 via switch 129*b*. The output of the powerstat is connected to a transformer 127 for stepping the 110-volt potential from source 120 down to a maximum of 12 volts. The output of the transformer is in turn connected to light connector 124*b*. In operation, switch 129*a* may be used to actuate or deactuate a solenoid-operated valve (not shown) which controls the flow of air to motor 36, while switch 129*b* and powerstat 130 may be used to actuate the light 71 for the television camera 76 and to regulate the brightness of this light, respectively.

Turning now to the pneumatic circuit of the invention, compressed air is admitted through inlet 132 via the solenoid-operated valve, where it passes through air filter 134. The compressed air then flows to T-junction 135 and branches off into conduits 136 and 144 as shown. Air flowing through conduit 136 flows through a three-way valve 139 which is the valve within the reversible air motor 136 operatively engaged to the air flow diverter button 42. Air leaving three-way valve 139 can flow through either outlet 141 or 143. If the three-way valve 139 diverts the compressed air to outlet 141, the air motor 136 will rotate the mandrel 11 in a counterclockwise, cage-tightening direction (looking down on the tool 1); however, if the three-way valve 139 diverts the compressed air to outlet 143, the mandrel 11 will be rotated in a counterclockwise, cage-loosening direction.

Turning back to air conduit 144, air leaving T-joint through this conduit passes through a regulator 137 and on to a valve 145. Valve 145 controls the flow of compressed air to an outlet 147 which leads to the hydraulic lifting cylinder 82 through the air line 84. In order to measure the pressure of the air entering the hydraulic lifting cylinder 82, an air gauge 150 is pneumatically connected between the valve 145 and outlet 147.

We claim as our invention:

1. A rolling tool for both expanding and reforming an off-round end of a tube, comprising a rotatable roller cage having a diameter which is approximately the same distance as the minimum diameter across the off-round tube end, a roller rotatably mounted within a slot in said roller cage, a tapered mandrel slidably movable within an opening in the cage for rotating, orbiting and radially extending the roller, and a ring which circumscribes at least a substantial portion of the cage and which is mounted stationarily with respect thereto for providing a surface around and against which the roller will rotate without stalling when said cage is inserted into said off-round tube end and said mandrel is rotated.

2. The rolling tool of claim 1, further including a plurality of rings having progressively larger inner diameters, the first of which has an inner diameter which is approximately the same as the minimum diameter of the off-round tube end, the last of which has an inner diameter approximately the same as the inner diameter of the tube, wherein the proximal end of said cage is rotatably mounted within a thrust collar, and wherein each of said rings is detachably mountable onto the thrust collar so that each of said rings may be sequentially used to reform and expand said tube end.

3. The rolling tool of claim 2, further including dovetail means for detachably mounting the rings to the thrust collar.

4. The rolling tool of claim 2, further including a frame for supporting a drive means for driving a rotatable mandrel, and a table assembly for supporting the thrust collar, a selected ring, roller cage and mandrel.

5. The rolling tool of claim 4, wherein said table assembly is slidably connected to the frame, and further including means for remotely and selectively sliding the table assembly into a tube engaging position.

6. The rolling tool of claim 5, wherein said means for selectively sliding the table assembly includes a single hydraulic cylinder.

7. The rolling tool of claim 5, wherein the slidable connection between the frame and the table assembly includes at least one ball-bushing slidably mounted onto a guide rod.

8. The rolling tool of claim 4, wherein the profile of the frame and table assembly is complementary to the arcuate profile of the bowl of the primary side of a nuclear steam generator.

9. The rolling tool of claim 4, wherein the drive means includes an elongated motor mounted within the frame in a position which will allow the frame and table assembly to be placed in the peripheral regions of the primary side of the tubesheet in a nuclear steam generator.

10. The rolling tool of claim 4, wherein the drive means includes torque limiting means for limiting the amount of torque which can be applied to the rotatable mandrel.

11. The rolling tool of claim 4, including means for detachably connecting the thrust collar to the table assembly.

12. The rolling tool of claim 4, including means for detachably connecting the mandrel from the table assembly.

13. The rolling tool of claim 2, further including means for resiliently biasing the cage against the off-round end of a tube.

14. A rolling tool for both expanding and reforming a dented end of a tube, comprising:

(a) a rotatable roller cage having an outer diameter which is approximately the same distance as the minimum inner diameter across the dented tube end;

(b) at least one roller rotatably mounted within a slot in the roller cage which is pitched with respect to the axis of rotation of the roller cage;

(c) a tapered mandrel slidably movable within an opening disposed along the axis of rotation of the roller cage for rotating, orbiting and radially extending the roller against the inner surface of the bent tube end;

(d) a thrust collar rotatably connected to the proximal end of the roller cage for limiting the extent to which the roller cage may be inserted within the dented tube end, and (e) a ring stationarily mounted around the proximal end of the roller cage for providing a surface around and against which the roller will rotate without stalling when said roller cage is inserted into the dented tube end and said mandrel is slidably extended through said opening and rotated.

15. The rolling tool of claim 14, further including a plurality of rings having progressively larger inner diameters, the first of which has an inner diameter which is approximately the same as the minimum diameter of the off-round tube end, the last of which has an inner diameter approximately the same as the inner diameter of the tube, wherein each of said rings is detachably mountable around the roller cage so that said rings can be used to reform and expand said tube end.

16. The rolling tool of claim 14, wherein each ring is detachably mountable onto the thrust collar.

17. The rolling tool of claim 14, further including a frame for supporting a drive means for driving the rotatable mandrel, and a table assembly for supporting the thrust collar, ring, roller cage and mandrel.

18. The rolling tool of claim 17, wherein the drive means is a reversible motor having a torque-limiting means for limiting the torque of the mandrel.

19. The rolling tool of claim 17, wherein said table assembly is slidably connected to the frame, and further including means for remotely and selectively sliding the table assembly into a tube engaging position.

20. The rolling tool of claim 19, wherein the thrust collar, ring, roller cage and mandrel are resiliently mounted onto the table assembly in order to bias the roller cage into the dented tube end when the table assembly is slid into a tube engaging position.

21. The rolling tool of claim 17, wherein the profile of the frame and table assembly is complementary to the arcuate profile of the bowl of the primary side of a nuclear steam generator.

22. The rolling tool of claim 17, wherein the drive means includes torque limiting means for limiting the amount of torque which can be applied to the rotatable mandrel.

23. The rolling tool of claim 17, including means for detachably connecting the mandrel from the table assembly.

24. A rolling rool for both expanding and reforming the dented end of a tube mounted in a tubesheet surrounded by a bowl-shaped structure, comprising:

(a) a rotatable roller cage having an outer diameter which is substantially the same distance as the minimum inner diameter across the dented tube end;

(b) a plurality of rollers rotatably mounted within slots in the roller cage which are pitched with respect to the axis of rotation of the roller cage;

(c) a tapered mandrel slidably movable within a bore concentrically disposed along the axis of rotation of the roller cage for rotating, orbiting and radially extending the roller against the inner surface of the bent tube end;

(d) a thrust collar rotatably connected to the proximal end of the roller cage for limiting the extent to which the roller cage may be inserted within the dented tube end;

(e) a a plurality of rings, each of which is stationarily and detachably mountable around the proximal end of the roller cage for providing a surface around and against which the rollers can rotate without stalling when the roller cage is inserted into the dented tube end and the mandrel is slidably extended through the bore in the cage and rotated, wherein said rings have progressively larger inner diameters, the first of which has an inner diameter which is approximately the same as the minimum diameter of the off-round tube end, the last of which has an inner diameter approximately the same as the inner diameter of the tube, and (f) a frame for holding a drive means for driving the mandrel and a table assembly for supporting the thrust collar, roller cage, one of said rings and said mandrel, and means for slidably connecting the frame and table assembly, wherein the profile of one side of the frame and table assembly is substantially complementary to the arcuate profile of the bowl surrounding the tubesheet of the nuclear steam generator.

25. A method for reforming and rolling the end of an off-round tube by means of a rolling tool having a roller cage with roller, a rotatable, tapered mandrel for radially extending, rotating and orbiting the rollers within the cage, and a plurality of rings, each of which is stationarily and detachably mountable around the proximal end of said roller cage, comprising the steps of (a) detachably mounting the first ring around the proximal end of said roller cage; (b) resiliently biasing the distal end of the rollers of the roller cage into the off-round tube end, (c) rotating the mandrel in order to partially reform said off-round tube, (d) removing the roller cage from said partially reformed tube end, and (e) repeating steps a-d with rings having progressively larger inner diameters until said tube end is reformed and expanded.

26. A method of reforming and rolling the dented ends of tubes mounted in a tubesheet by means of a plurality of rolling tools having a roller cage with pitched rollers, and a rotatable, tapered mandrel for rotating, orbiting and radially extending the rollers of the cage, comprising the steps of:

(a) inserting the distal end of a first roller cage into the dented tube end whose outer diameter is approximately the same as the initial minimum inner diameter of the dented tube end;

(b) providing a ring around the proximal end of the first roller cage having an inner diameter which is approximately the same as the initial minimum inner diameter of the dented tube end;

(c) rotating the mandrel while biasing the mandrel toward the dented tube end in order to rotate, orbit and radially extend the rollers against both the inner diameter of the ring, and the inner diameter of the dented tube end in order to partially reform the dented tube end by increasing the initial minimum inner diameter thereof to a second minimum inner diameter;

(d) withdrawing the first roller cage from the dented tube end;

(e) inserting the distal end of a second roller cage into the dented tube end whose outer diameter is approximately the same as the second minimum inner diameter of the dented tube end;

(f) providing a second ring around the proximal end of the first roller cage which has an inner diameter which is approximately the same as the second minimum inner diameter of the dented tube end;

(g) repeating step (c) in order to partially reform the dented tube end by increasing the second minimum inner diameter of the dented tube end to a third minimum inner diameter;

(h) withdrawing the second roller cage from the dented tube end, and (i) repeating steps (f) through (h) until the dented tube end is completely reformed, and (j) rolling the tube end to a desired final diameter.

* * * * *